US005698151A

United States Patent [19]

Zikeli et al.

[11] Patent Number: 5,698,151

[45] Date of Patent: *Dec. 16, 1997

[54] PROCESS OF MAKING CELLULOSE FIBRES

[75] Inventors: Stefan Zikeli, Regau; Friedrich Ecker, Timelkam; Franz Schwenninger; Raimund Jurkovic, both of Lenzing; Hartmut Rüf, Vöcklbruck, all of Austria

[73] Assignee: Lenzing Aktiengesellschaft, Lenzing, Austria

[ * ] Notice: The term of this patent shall not extend beyond the expiration date of Pat. No. 5,589,125.

[21] Appl. No.: 214,953

[22] Filed: Mar. 14, 1994

[30] Foreign Application Priority Data

Jul. 1, 1993 [AT] Austria ..... 1291/93

[51] Int. Cl.[6] ..... D01F 2/24

[52] U.S. Cl. ..... 264/187; 264/211.14; 264/211.16; 264/237

[58] Field of Search ..... 264/187, 203, 264/211.14, 211.16, 237

[56] References Cited

U.S. PATENT DOCUMENTS

| | | | |
|---|---|---|---|
| 2,179,181 | 11/1939 | Graenacher et al. | 106/203 |
| 2,284,028 | 5/1942 | Ubbelohde | 264/143 |
| 3,118,012 | 1/1964 | Kilian | 264/211.14 |
| 3,299,469 | 1/1967 | Charlton . | |
| 3,619,452 | 11/1971 | Harrison et al. | 264/211.14 |
| 3,824,050 | 7/1974 | Balk | 425/72.2 |
| 3,858,386 | 1/1975 | Stofan . | |

(List continued on next page.)

FOREIGN PATENT DOCUMENTS

| | | | |
|---|---|---|---|
| 354596 | 6/1979 | Austria . | |
| 40482 | 11/1981 | European Pat. Off. . | |
| 50483 | 4/1982 | European Pat. Off. . | |
| 105169 | 4/1984 | European Pat. Off. . | |
| 442405 | 8/1991 | European Pat. Off. . | |
| 494852 | 7/1992 | European Pat. Off. . | |
| 356419 | 12/1992 | European Pat. Off. . | |
| 898802 | 5/1945 | France . | |
| 218121 | 1/1985 | German Dem. Rep. . | |
| 2830685 | 2/1979 | Germany . | |
| 2844163 | 5/1979 | Germany . | |
| 3406346 | 10/1984 | Germany . | |
| 3708168 | 9/1988 | Germany . | |
| 57-161113 | 10/1982 | Japan | 264/211.14 |
| 61-119704 | 6/1986 | Japan | 264/211.14 |
| 807248 | 1/1959 | United Kingdom . | |
| 957534 | 5/1964 | United Kingdom | 264/211.14 |
| 1017855 | 6/1964 | United Kingdom . | |
| WO93/19230 | 9/1993 | WIPO | 264/187 |

OTHER PUBLICATIONS

English language abstract of German Patent No. 218 121.
English language abstract of German Patent No. 28 30 685.
English language abstract of German Patent No. 28 44 163.
English language abstract of German Patent No. 3 406 346.
English language abstract of J57–161113.
English language abstract of J61–119704.
English language abstract of European Patent No. 105 169.
English language abstract of European Patent No. 356 419.
English language abstract of European Patent No. 494 852.
English language abstract of Austrian Patent Application No. 2724/89.
"How To Estimate The Flow Characteristics In Multifilament Spinning", by Dr. Andrzej Zachara, Jul. 1987 Fiber World, pp. 52–63.

*Primary Examiner*—Leo B. Tentoni
*Attorney, Agent, or Firm*—Brumbaugh, Graves, Donohue & Raymond

[57] ABSTRACT

To prepare cellulose fibres, a solution of cellulose in a tertiary amine-oxide is shaped in hot condition to give filaments, the filaments are cooled and then introduced into a precipitation bath in order to precipitate the dissolved cellulose, whereby the shaped solution is exposed to an essentially laminar gas stream (FIG. 2*a*) for cooling before introduction into the precipitation bath.

5 Claims, 4 Drawing Sheets

U.S. PATENT DOCUMENTS

| | | | |
|---|---|---|---|
| 3,969,462 | 7/1976 | Stofan | 264/237 |
| 3,996,321 | 12/1976 | Weinberger | 264/40.3 |
| 4,038,357 | 7/1977 | Boyes et al. | 264/168 |
| 4,078,034 | 3/1978 | Lewis | 264/181 |
| 4,144,080 | 3/1979 | McCorsley, III | 106/186 |
| 4,261,943 | 4/1981 | McCorsley, III | 264/187 X |
| 4,285,646 | 8/1981 | Waite | 425/72.2 |
| 4,340,559 | 7/1982 | Yang | 264/181 |
| 4,440,711 | 4/1984 | Kwon et al. | 264/185 |
| 4,713,290 | 12/1987 | Kwon et al. | 428/364 |
| 4,836,507 | 6/1989 | Yang | 264/143 |
| 5,094,690 | 3/1992 | Zikeli et al. | 106/198 |
| 5,252,284 | 10/1993 | Jurkovic et al. | 264/187 |

PROCESS OF MAKING CELLULOSE FIBRES

BACKGROUND OF THE INVENTION

The invention concerns a process for the preparation of cellulose fibres in which a solution of cellulose in a tertiary amine-oxide is shaped in hot condition to give filaments, the filaments are cooled and are then introduced into a precipitation bath in order to precipitate the dissolved cellulose, as well as a device for carrying out the process.

It is known from U.S. Pat. No. 2,179,181 that tertiary amine-oxides are capable of dissolving cellulose and that cellulose fibres can be obtained from these solutions by precipitation. A process for the preparation of such solutions is known for example from EP-A 0 356 419. According to this publication, a suspension of cellulose is firstly prepared in aqueous tertiary amine-oxide. The amine-oxide contains up to 40 weight % water. The aqueous cellulose suspension is heated and water is removed under reduced pressure until the cellulose dissolves. The process is carried out in a specially-developed stirring device which can be evacuated.

When preparing cellulose fibres, it is known from DE-A 2 844 163 to provide an air gap between the spinning die, ie, the spinneret, and the precipitation bath to achieve drawing at the die. This drawing at the die is necessary because drawing of the fibres becomes very difficult after the shaped spinning solution is brought in contact with the aqueous precipitation bath. The fibre structure which is set in the air gap is fixed in the precipitation bath.

A process of the type mentioned above is known from DE-A 2 830 685, wherein a solution of cellulose in a tertiary amine-oxide is shaped in hot condition to give filaments which are cooled with air and then introduced into a precipitation bath in order to precipitate the dissolved cellulose. The surface of the spun fibres is also wetted with water to reduce their tendency to adhere to neighbouring fibres.

It has been shown that all processes of the prior art concerning the preparation of filaments and the textile properties of the fibres are unsatisfactory.

On account of the short spinning gad between the spinneret and the precipitation bath, which is in the region of a few centimeters, and the short period of time available in which the properties of the fibre can be adjusted, it is difficult to achieve for instance a uniform titre and a uniform strength and elongation for all the filaments in the fibre bundle and for the fibres obtained after precipitation.

SUMMARY OF THE INVENTION

It is an object of the invention to improve the type of process mentioned above wherein a dense fibre bundle can be spun from a spinneret having a high density of holes and wherein the textile properties of the spun fibre can be better adjusted.

This problem is solved according to the invention in a process for preparing cellulose fibres wherein a solution of cellulose in a tertiary amine-oxide is shaped into filaments in hot condition and the filaments are cooled and subsequently introduced into a precipitation bath in order to precipitate the dissolved cellulose, the shaped solution is exposed to an essentially laminar gas stream before introduction into the precipitation bath.

The invention is based on the finding that the textile properties of the fibres can be affected by blowing an inert gas, preferably air, through them. As well as affecting the fibre quality, the process of cooling the filaments emerging from the spinneret also affects the drawing and elongation of the filaments. It has been shown according to the invention that fibres with uniform properties can be prepared when a stream of cooling gas is blown through the freshly extruded filaments; the gas stream should exhibit as little turbulence as possible, ie, it should exhibit substantially laminar flow. This leads to a definite improvement of the spinning process.

A preferred embodiment of the process according to the invention consists of the laminar gas flow being directed substantially at right angles to the filaments.

It has proved to be advantageous to lead the hot cellulose solution through a spinneret having a multiplicity of spinning holes which are arranged in a ring shape disposition, whereby a ring shaped fibre bundle is formed and whereby the laminar gas stream is provided in the centre of the ring formed by the spinning holes and is directed radially in an outwards direction.

The invention also concerns a device for carrying out the process according to the invention, which includes an inlet for cooling gas and a spinneret with spinning holes which are arranged essentially in a ring shape disposition to ensure formation of a ring shaped fibre bundle, characterised in that, the inlet for cooling gas is provided in the centre of the ring formed by the spinning hole arrangement and the inlet is of a type such that an essentially laminar gas stream strikes the filaments which are cooled by the laminar gas stream.

A desirable implementation of the device according to the invention consists of the inlet for cooling gas having a piped-shaped inlet and a baffle plate to deflect the gas stream, whereby the baffle plate is so arranged that the gas stream remains as laminar as possible during deflection.

The invention further concerns the use of the device according to the invention for the preparation of cellulose fibres from a solution of cellulose in a tertiary amine-oxide.

BRIEF DESCRIPTION OF THE DRAWINGS

The process according to the invention is still further explained by means of the Drawings, whereby FIG. 1 schematically shows the operation of a dry/wet spinning process for the preparation of cellulose fibres in accordance with the prior art.

DETAILED DESCRIPTION OF THE PREFERRED EMBODIMENTS

Figure 1:
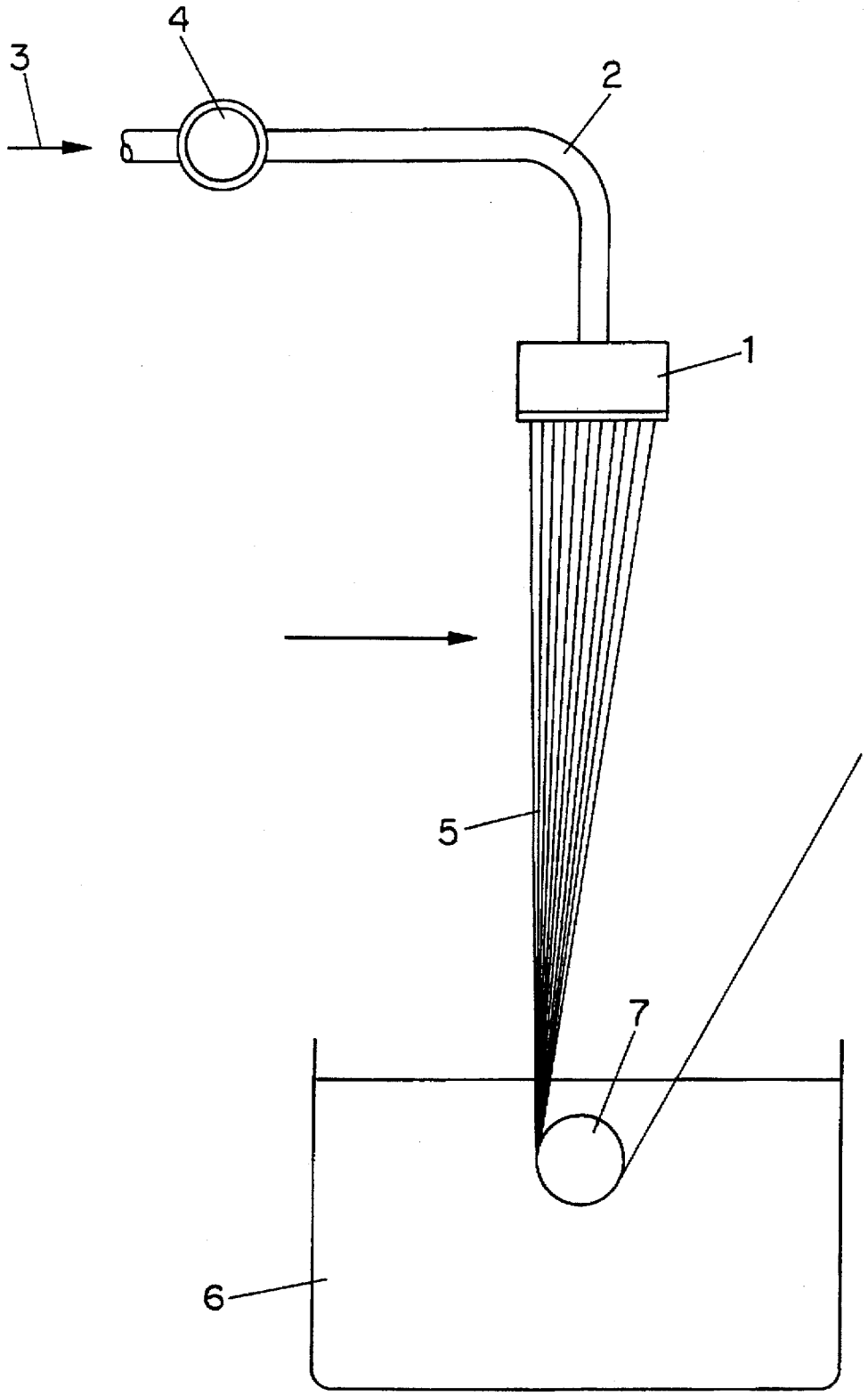

FIG. 1 shows a heatable spinneret (1) (the heating is not shown) which is supplied through an inlet (2) with spinning material (3), ie, hot cellulose solution at a temperature of about 100° C. The pump (4) meters the spinning dope and provides the pressure necessary for extrusion. The fibre bundle extruded from the spinning holes of the spinneret (1) is marked with the reference number (5).

The fibre bundle (5) passes through an air gap which is given by the distance of the spinneret (1) from the surface of the precipitation bath (6), passes into the precipitation bath (6), and is then collected by a deflection roller (7) and is drawn off. The extruded fibre bundle (5) is cooled with air which is shown schematically in the Figure by an arrow.

Drawing is achieved by drawing off the fibre bundle (5) over the roller (7) at a velocity which is higher than the velocity at which the fibre bundle leaves the spinneret (1).

Figure 2A:
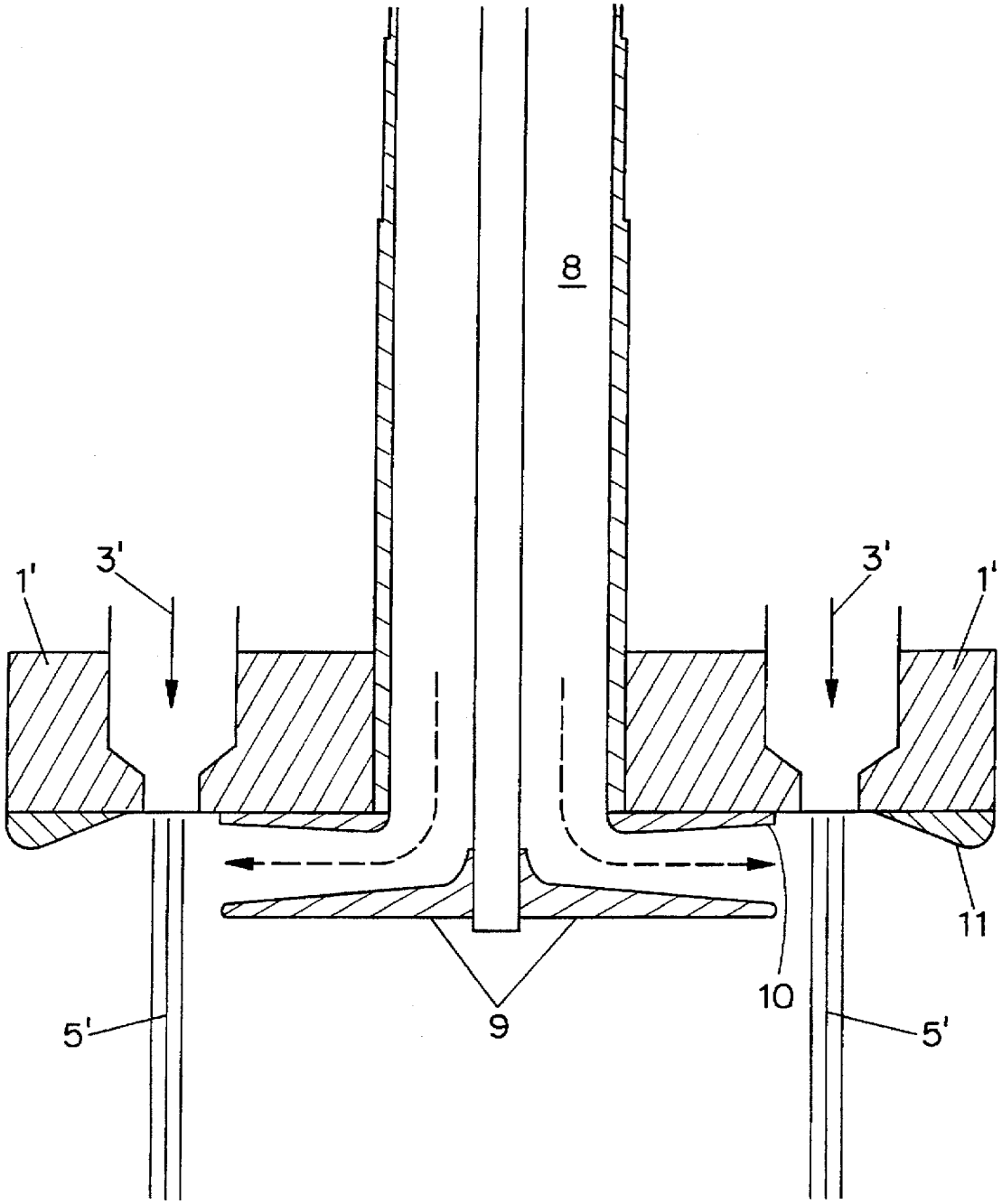
FIG. 2*a* shows a preferred embodiment of the spinning device according to the invention.

FIG. 2*a* shows a cross-section of an annular, heatable (heating not shown) spinneret (1') and a blowing device consisting of a central pipe-shaped inlet (8) for cooling gas and a baffle plate (9) for deflecting the gas stream from a vertical direction to a substantially horizontal direction. The annular spinneret (1') is supplied with spinning dope (3') at a point not shown in the Drawing and this dope is spun into a dense ring shaped fibre bundle (5') through which cooling gas is blown from the inside. The direction in which the gas is blown is indicated in the Figure by an hyphenated arrow. The cooling air thus emerges from a circular slit-die which is formed by the baffle plate (9) and the opposing face (10).

The gas stream strikes the plate-shaped baffle plate (9), is deflected horizontally, emerges as a laminar gas stream and impinges on the ring shaped fibre bundle (5') at its inner side.

The embodiment of the device according to the invention shown in FIG. 2*a* has a baffle plate to generate a laminar stream of cooling gas; this baffle plate deflects the vertical cooling gas stream into an essentially horizontal gas stream without any abrupt transition. That part of FIG. 2*a* which is provided to maintain laminar gas flow is shown enlarged in FIG. 2*b*. The angles drawn into FIG. 2*b* preferably have the following values:

$\alpha$ (baffle plate): $\leqq 12°$, preferably: 3°–8°;

$\beta$ (upper guiding face): $\leqq 10°$, preferably: 4°–8°;

$\delta$ (outer bulge): $\leqq 30°$, preferably: 15°–25°;

$\sigma$ ($\alpha+\beta$): $\leqq 22°$.

An abrupt transition between the inlet (8) and the baffle plate (9) leads to compression of the air stream with formation of a high degree of turbulence.

Figure 3:
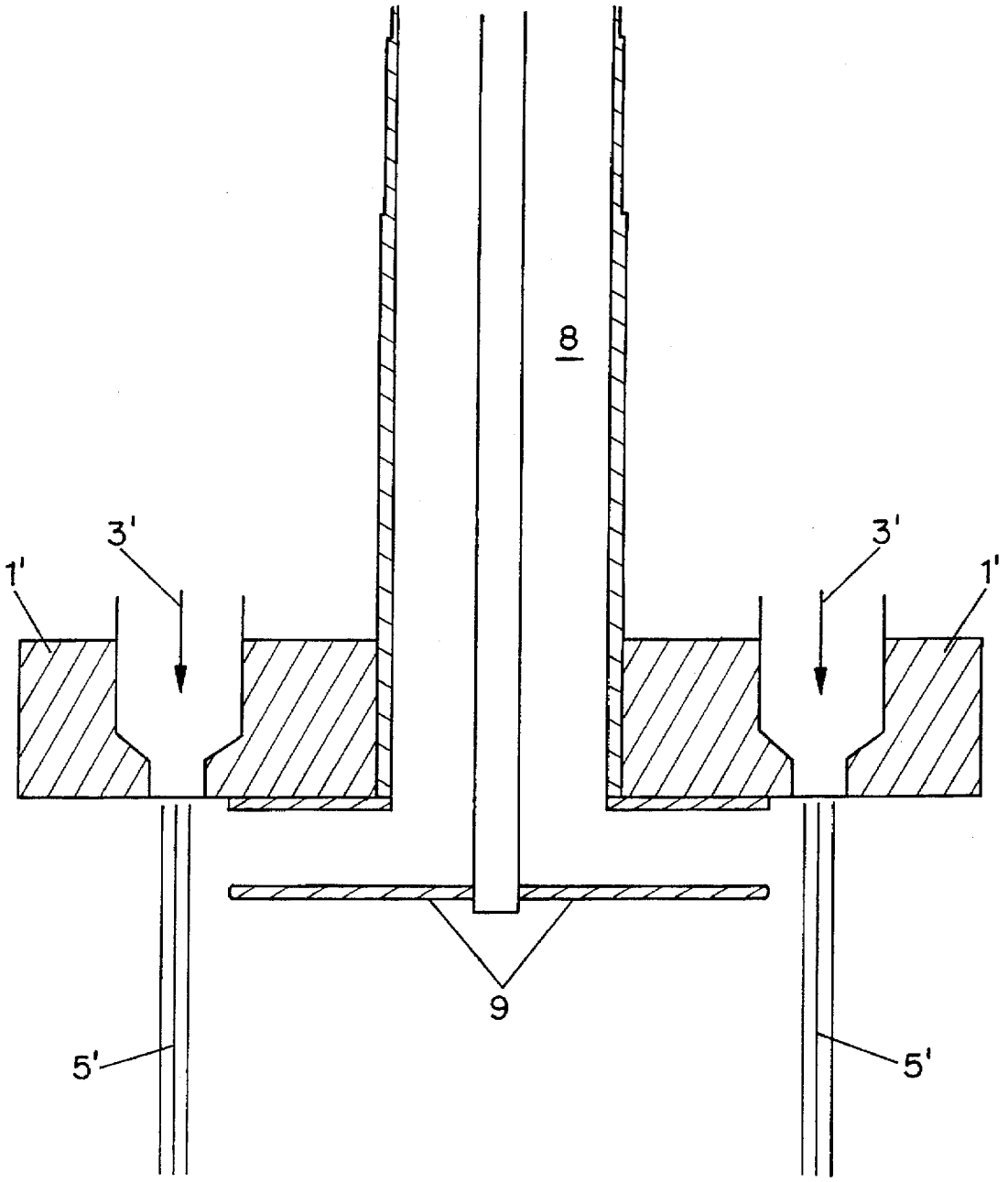

Such a device, which is not in accordance with the invention, is shown in FIG. 3.

Figure 2B:
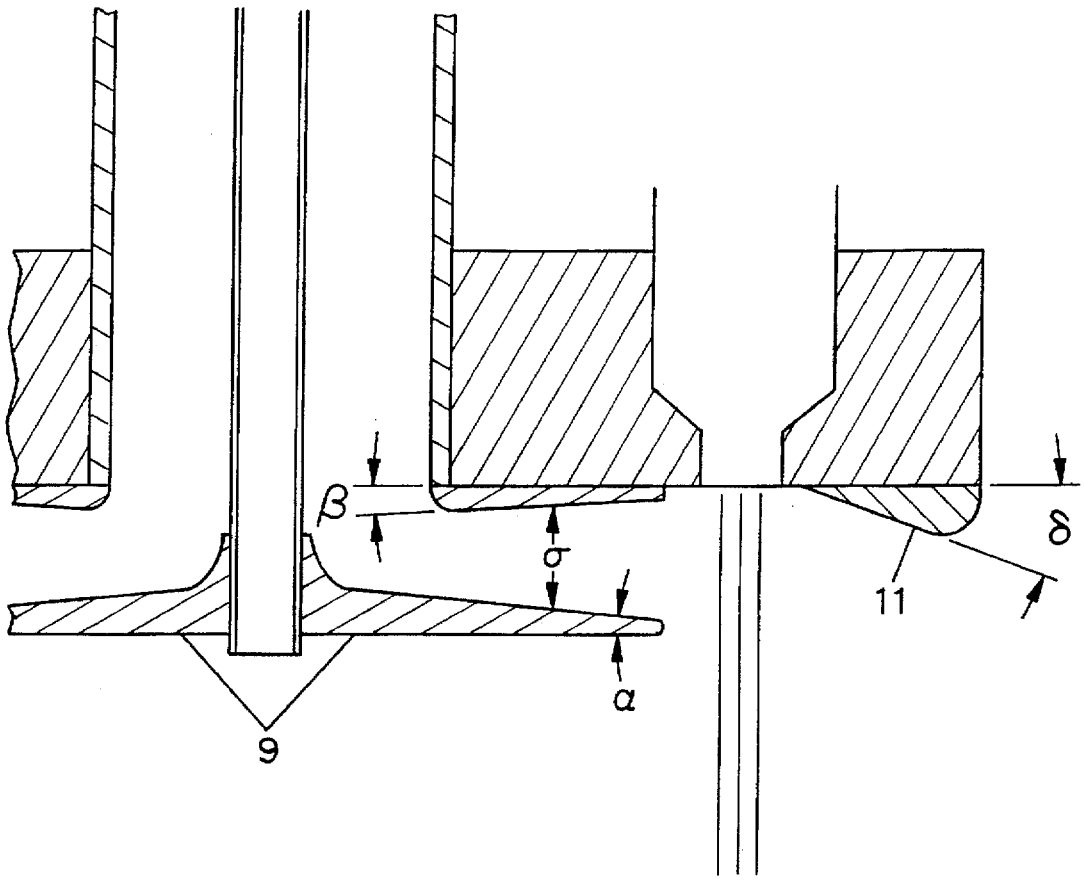
FIG. 2*b* shows a section of FIG. 2*a* on an enlarged scale. For comparison, a device which does not exhibit the characteristics according to the invention is shown in FIG. 3.

The device for blowing the gas shown in FIG. 2*b* can either form a constructional entity with the spinneret (1') or it can be a separate structural unit on which the annular spinneret (1') rests. Insulation (not shown) is preferably provided between the blowing device and the spinneret to prevent heat transfer from the spinning material to the cooling air.

It is also desirable that the circular exit slit, after deflection of the gas stream, opens out to a total opening angle of $\leqq 22°$. Flow resistance to the cooling gas is minimised by the continuous increase in diameter. The small total opening angle prevents break-up of the stream of cooling gas and allows a turbulent-free gas stream to be blown through the filaments.

It has also been shown that after passage of the gas stream through the fibre bundle, part of it returns newly-warmed to the fibre bundle due to the formation of turbulence and this leads to unsatisfactory and uneven cooling. This results in the filament bundle having variable draw properties which can lead to an uneven filament bundle as the drawing force is applied, and this in turn can lead to capillary cracks, to spinning faults and to adhesion between the filaments. In order to avoid these defects and to optimise the spinning process still further, a preferred implementation of the device according to the invention has an annular bulge (11) which slightly deflects the cooling gas stream which has passed through the fibre bundle away from and below the plane of the spinneret.

The invention is still further explained by means of the following Examples.

Example and comparative Example

A cellulose solution prepared in accordance with the process described in EP-A 0 356 419 was filtered and was spun in hot condition according to the process shown in FIG. 1, whereby the spinning device used was that shown in cross-section in FIG. 2*a* whilst in the comparative Example the spinning device used was that shown in cross-section in FIG. 3.

Both devices had the same internal diameter (44 mm) for the pipe-shaped inlet (8) for cooling gas and the same diameter (104 mm) for the baffle plate (9). In the Example (device according to the invention) the angles $\alpha$ and $\beta$ each amounted to 5°; the total opening angle $\sigma$ thus amounted to 10°. The angle $\delta$ amounted to 5°.

In the Table the following data are given for both the Example and for the comparative Example:

the weight of cellulose solution spun/hr (kg/h), its composition (wt%), its temperature (°C.) during spinning, the hole density (number of holes/mm$^2$) in the spinneret, the diameter of the spinning holes ($\mu$), the draw ratio at the die, the input of cooling air (m$^3$/h), the temperature of the cooling air(°C.), the temperature of the effluent internal cooling air (°C.), the fibre draw ratio, the NMMO content of the precipitation bath (wt% NMMO), and the end titre (dtex) of the fibre prepared.

TABLE

| | Example | Comparative Example |
|---|---|---|
| Cellulose solution (kg/h) | 27.6 | 27.6 |
| Cellulose content (wt %) | 15 | 15 |
| Temp. of cellulose soln. (°C.) | 117 | 117 |
| Hole density (holes/mm$^2$) | 1.59 | 1.59 |
| Hole diameter ($\mu$m) | 100 | 100 |
| Die draw ratio | 14.5 | 12.4 |
| Cooling air (m$^3$/h) | 34.8 | 34.8 |
| Temp. of cooling air fed | 21 | 21 |
| Temp. of cooling air removed | 36 | 36 |
| Precipitation bath (% NMMO) | 20 | 20 |
| Precipitation bath temperature | 20 | 20 |
| Minimal fibre titre (dtex) | 1.18 | 1.38 |

It is thus shown that by using the gas blowing device having the favourable gas-flow design, the attainable fibre fineness (=minimal fibre titre in dtex) is very decisively influenced by the flow of cooling gas. A die draw ratio of 14.5:1 can only be achieved with the blowing device according to the invention. This obtained a fibre fineness of 1.18 dtex. In the comparative Example, the attainable fibre fineness was about 20% less favourable.

We claim:

1. In a process for the preparation of cellulose fibres in which a heated solution of cellulose in a tertiary amine oxide is shaped to form filaments, the steps of:

cooling the filaments formed from the heated solution by exposing them to an essentially laminar gas stream prior to introducing the filaments into a precipitation bath, and introducing the filaments into a precipitation bath to precipitate the dissolved cellulose in said filaments.

2. The process according to claim 1 wherein the laminar gas stream is directed at a substantially right angle to the filaments formed from the heated solution.

3. Process according to claim 1 or claim 2 comprising forming a heated shaped cellulose solution by conveying a heated cellulose solution through a spinneret having a multiplicity of spinning holes which are arranged in a ring shape thereby shaping the heated cellulose solution into a bundle of filaments arranged in a ring shape, and providing a laminar gas stream in the center of the ring of spinning holes wherein the gas stream is directed radially outward.

4. Method for the preparation of cellulose fibres in which a heated solution of cellulose in a tertiary amine oxide is shaped to form filaments using an apparatus comprising a spinneret having spinning holes arranged in a ring shape which shape the cellulose solution into a bundle of filaments arranged in a ring shape, and an inlet for cooling gas located in the center of the ring formed by the spinning holes, the inlet adapted to provide an essentially laminar gas stream, said method comprising:

providing a heated solution of cellulose in a tertiary amine oxide, conveying the heated cellulose solution through the spinning holes of the spinneret thereby shaping the heated cellulose solution into a bundle of filaments arranged in a ring shape, striking the filaments with the essentially laminar gas stream thereby cooling the filaments, conveying the cooled filaments into a precipitation bath.

5. Method according to claim 4 wherein the inlet for cooling gas comprises a pipe-shaped inlet portion and baffle plate for deflecting the gas stream, wherein the baffle plate is arranged to provide an essentially laminar gas stream for cooling the filaments.

* * * * *